US009410280B2

(12) United States Patent
Hettinger

(10) Patent No.: US 9,410,280 B2
(45) Date of Patent: Aug. 9, 2016

(54) WASHING MACHINE APPLIANCES AND METHODS FOR OPERATING THE SAME

(71) Applicant: General Electric Company, Schenectady, NY (US)

(72) Inventor: Stephen Edward Hettinger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 222 days.

(21) Appl. No.: 14/158,975

(22) Filed: Jan. 20, 2014

(65) Prior Publication Data

US 2015/0204004 A1 Jul. 23, 2015

(51) Int. Cl.

| | |
|---|---|
| ***D06F 33/02*** | (2006.01) |
| ***D06F 39/08*** | (2006.01) |
| *D06F 39/00* | (2006.01) |
| *D06F 39/04* | (2006.01) |

(52) U.S. Cl.

CPC ..... *D06F 39/088* (2013.01); *D06F 33/02* (2013.01); *D06F 39/005* (2013.01); *D06F 39/04* (2013.01); *D06F 2202/04* (2013.01); *D06F 2204/06* (2013.01); *D06F 2204/088* (2013.01)

(58) Field of Classification Search

None

See application file for complete search history.

(56) References Cited

U.S. PATENT DOCUMENTS

| | | | | |
|---|---|---|---|---|
| 6,125,490 | A * | 10/2000 | Riechman | D06F 35/006 68/12.02 |
| 7,246,395 | B2 | 7/2007 | Buckroyd et al. | |
| 8,261,391 | B2 * | 9/2012 | Luckman | D06F 35/006 8/159 |
| 8,490,440 | B2 * | 7/2013 | Aykroyd | D06F 33/02 68/12.12 |
| 2008/0000272 | A1 * | 1/2008 | Park | D06F 35/005 68/12.03 |
| 2011/0283216 | A1 * | 11/2011 | Buyuktopcu | A47L 15/4293 715/771 |
| 2012/0311794 | A1 | 12/2012 | Hettinger et al. | |
| 2015/0000047 | A1 * | 1/2015 | Obregon | D06F 33/02 8/137 |
| 2015/0074918 | A1 * | 3/2015 | Suel, II | D06F 33/02 8/137 |

FOREIGN PATENT DOCUMENTS

| | | | | |
|---|---|---|---|---|
| BE | WO 2014032942 | A1 * | 3/2014 | D06F 39/083 |
| JP | 2001-259282 | A | 9/2001 | |
| KR | EP 2135988 | A1 * | 12/2009 | D06F 39/005 |

* cited by examiner

*Primary Examiner* — Michael Barr

*Assistant Examiner* — Cristi Tate-Sims

(74) *Attorney, Agent, or Firm* — Dority & Manning, P.A.

(57) ABSTRACT

Washing machine appliances and method for operating washing machine appliances are provided. A washing machine appliance has a tub and a basket rotatably mounted within the tub, the basket defining a chamber for receipt of articles for washing. A method includes flowing a first volume of liquid into the tub, the first volume of liquid at a temperature correlated to a treatment option selected by a user, and agitating the articles within the tub for a first period at a first rate. The method further includes flowing a second volume of liquid into the tub, the second volume of liquid at a temperature correlated to a temperature option selected by a user, and agitating the articles within the tub for a second period at a second rate.

10 Claims, 3 Drawing Sheets

FIG. —1—

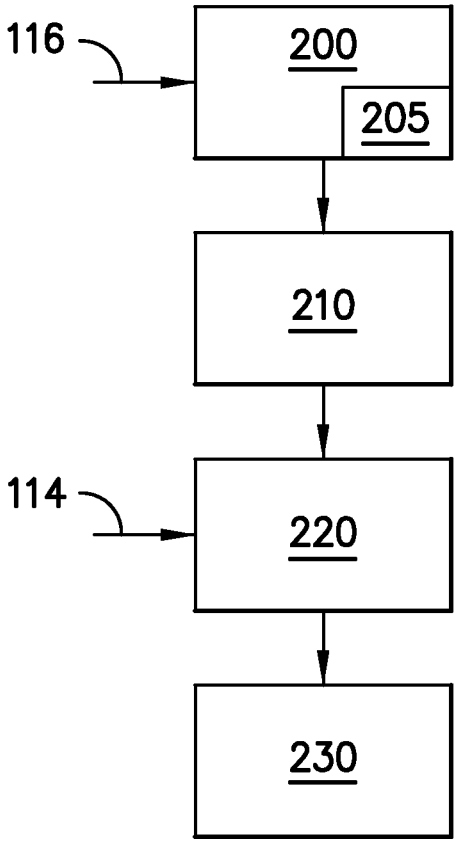
FIG. –3–

WASHING MACHINE APPLIANCES AND METHODS FOR OPERATING THE SAME

FIELD OF THE INVENTION

The present subject matter relates generally to washing machine appliances and methods for operating washing machine appliances.

BACKGROUND OF THE INVENTION

Washing machine appliances generally include a tub for containing wash fluid, e.g., water and detergent, bleach and/or other wash additives. A basket is rotatably mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

Frequently, washing machine appliance users desire to wash articles therein that have stains on the articles. Many washing machine appliances include treatment options for such stains. Selection of a treatment option typically causes the washing machine appliance to operate at settings that are desirable for removal of the stain.

However, currently known washing machine appliances which provide such treatment options have limitations. For example, when a treatment option is selected, such selection may cause the washing machine appliance to operate using water at a certain temperature for stain removal. However, the user may not desire to operate the washing machine appliance with water at this temperature, and may rather desire hotter or colder water for such washing. The water temperature associated with a selected treatment option may conflict with the desired water temperature, such that selection of a treatment option may override the user's ability to select a desired water temperature.

Some washing machine appliances utilized a separate pre-wash cycle for stain removal. However, use of such a cycle requires the addition of a pre-wash additive tray such that detergent, etc. can be added to the water for the pre-wash cycle and separately added for the regular wash cycle.

Accordingly, improved washing machine appliances and methods for operating washing machine appliances are desired. In particular, washing machine appliances and associated methods which allow users to select a treatment option independently of a desired wash temperature, and which operate based on such selections, would be advantageous.

BRIEF DESCRIPTION OF THE INVENTION

In accordance with one embodiment of the present disclosure, a method for operating a washing machine appliance is provided. The washing machine appliance has a tub and a basket rotatably mounted within the tub, the basket defining a chamber for receipt of articles for washing. The method includes flowing a first volume of liquid into the tub, the first volume of liquid at a temperature correlated to a treatment option selected by a user, and agitating the articles within the tub for a first period at a first rate. The method further includes flowing a second volume of liquid into the tub, the second volume of liquid at a temperature correlated to a temperature option selected by a user, and agitating the articles within the tub for a second period at a second rate.

In accordance with another embodiment of the present disclosure, a washing machine appliance is provided. The washing machine appliance includes a tub, and a basket rotatably mounted within the tub, the basket defining a wash chamber for receipt of articles for washing. The washing machine appliance further includes a valve, a nozzle configured for flowing liquid from the valve into the tub, and a motor in mechanical communication with the basket, the motor configured for selectively agitating the articles within the tub. The washing machine appliance further includes a controller in operative communication with the valve and the motor. The controller is configured for flowing a first volume of liquid into the tub, the first volume of liquid at a temperature correlated to a treatment option selected by a user, and agitating the articles within the tub for a first period at a first rate. The controller is further configured for flowing a second volume of liquid into the tub, the second volume of liquid at a temperature correlated to a temperature option selected by a user, and agitating the articles within the tub for a second period at a second rate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 3 provides a flow chart of an exemplary method for operating a washing machine appliance according to an exemplary embodiment of the present subject matter.

DETAILED DESCRIPTION

Figure 1:
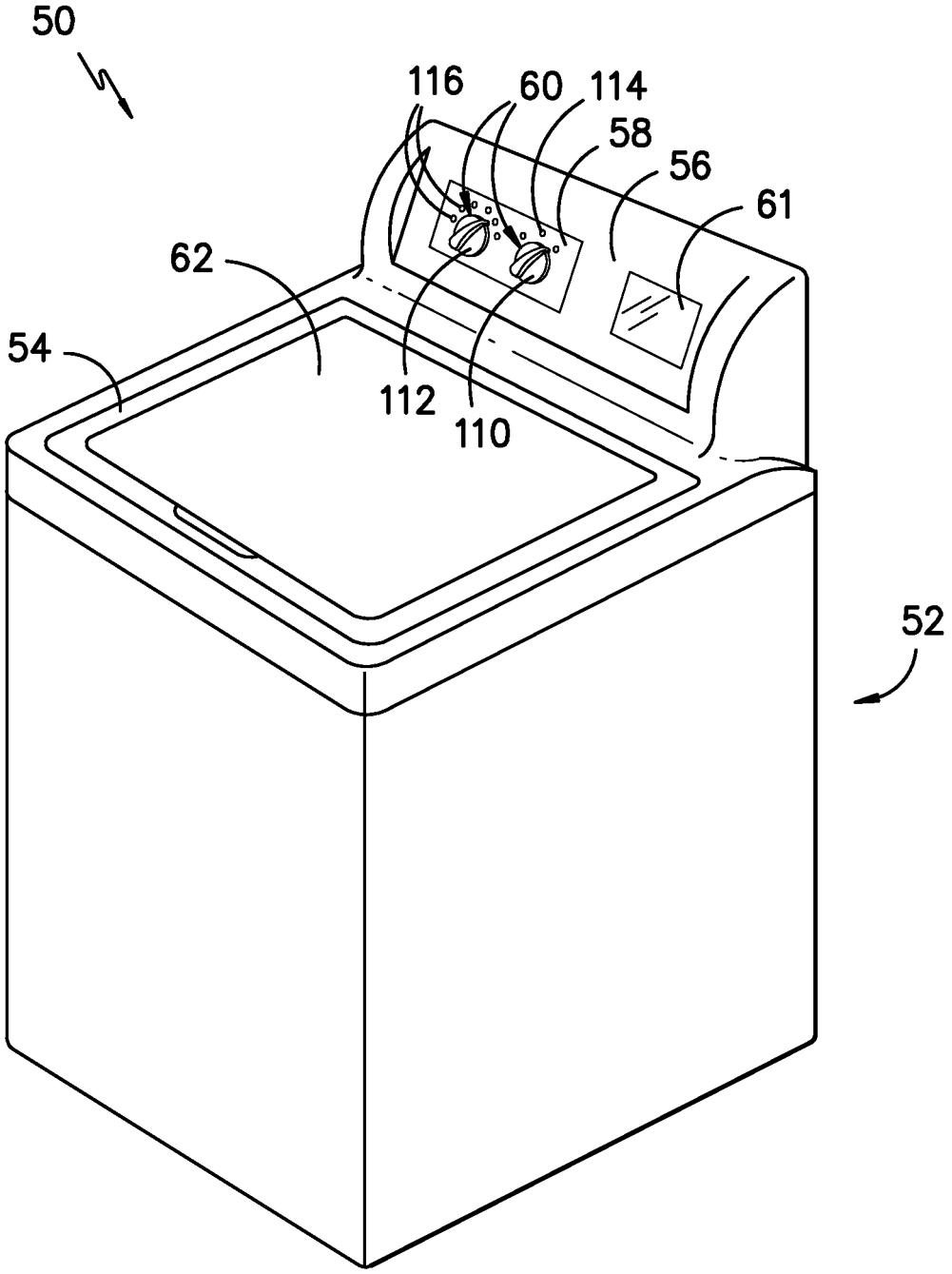
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over tub 64.

Figure 2:
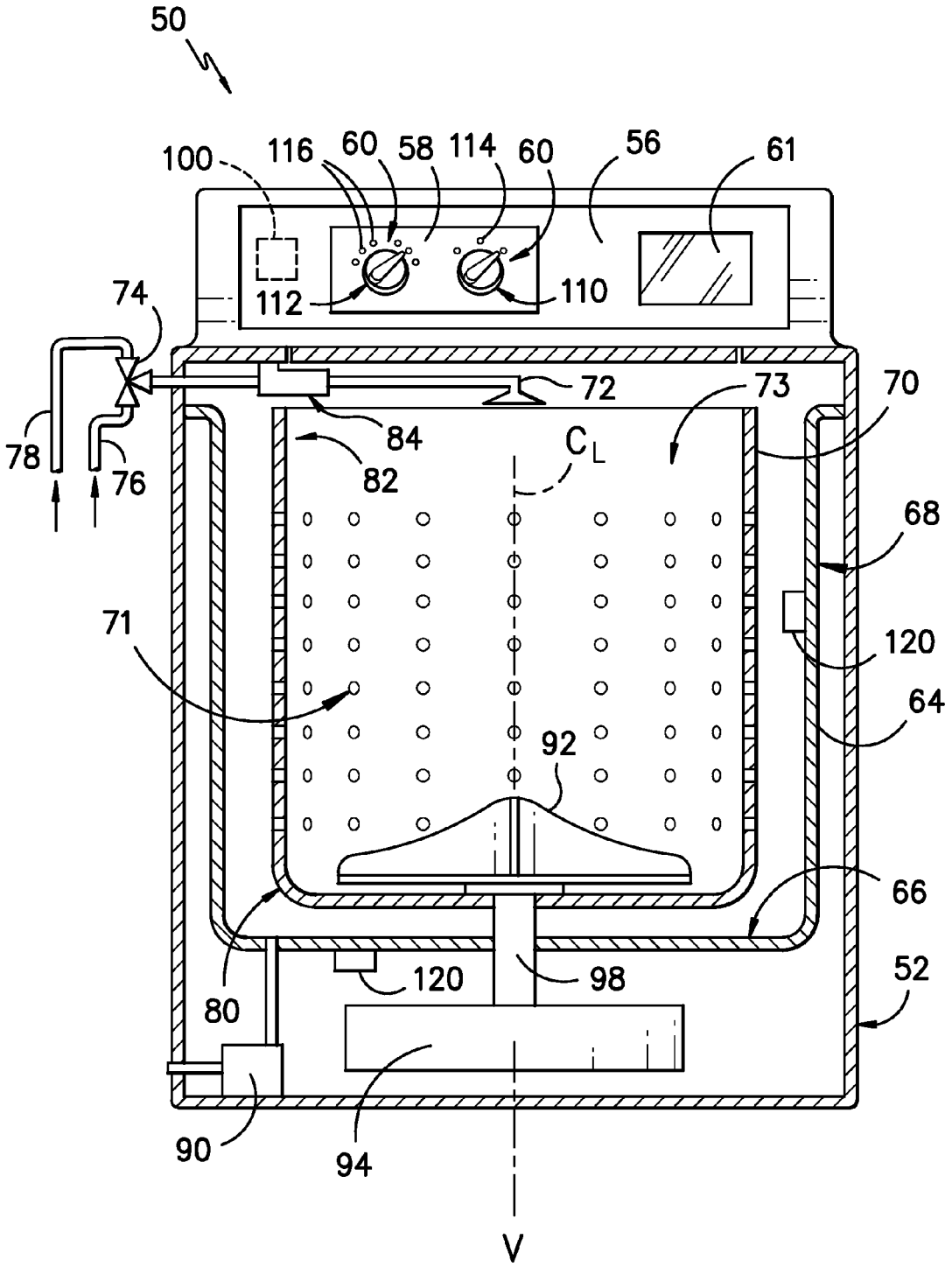
FIG. 2 provides a front, section view of the exemplary washing machine appliance of FIG. 1.

FIG. 2 provides a front, cross-section view of washing machine appliance 50. As may be seen in FIG. 2, tub 64 includes a bottom wall 66 and a sidewall 68. A wash drum or wash basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with a water supply (not shown) in order to direct liquid (e.g. water) into tub 64 and/or onto articles within chamber 73 of basket 70. A valve 74 regulates the flow of fluid through nozzle 72. For example, valve 74 can selectively adjust to a closed position in order to terminate or obstruct the flow of fluid through nozzle 72. A cold liquid conduit 76 and a hot liquid conduit 78 may additionally be in fluid communication with the water supply, and may supply cold and hot liquid, respectively, to the nozzle 72 through valve 74. Valve 74 may further be operable to regulate the flow of hot and cold liquid, and thus the temperature of the resulting liquid flowed through nozzle 72 into tub 64. An additive dispenser 84 may additionally be provided for directing a wash additive, such as detergent, bleach, etc., into the tub 64. For example, dispenser 84 may be in fluid communication with nozzle 72 such that liquid flowing through nozzle 72 flows through dispenser 84, mixing with wash additive at a desired time during operation to form a wash fluid, before being flowed into tub 64. A pump assembly 90 (shown schematically in FIG. 2) is located beneath tub 64 and basket 70 for gravity assisted flow to drain tub 64.

An agitation element 92, shown as an impeller in FIG. 2, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Basket 70 and agitation element 92 are driven by a motor 94, such as a pancake motor. As motor output shaft 98 is rotated, basket 70 and agitation element 92 are operated for rotatable movement within tub 64, e.g., about vertical axis V. Washing machine appliance 50 may also include a brake assembly (not shown) selectively applied or released for respectively maintaining basket 70 in a stationary position within tub 64 or for allowing basket 70 to spin within tub 64.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as valve 74, motor 94, etc. In response to user manipulation of the input selectors 60, controller 100 may operate the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses.

In an illustrative embodiment, laundry items are loaded into chamber 73 of basket 70, and washing operation is initiated through operator manipulation of control input selectors 60. Tub 64 is filled with water and mixed with detergent to form a wash fluid. Valve 74 can be opened to initiate a flow of water into tub 64 via nozzle 72, and tub 64 can be filled to the appropriate level for the amount of articles being washed. Once tub 64 is properly filled with wash fluid, the contents of the basket 70 are agitated with agitation element 92 for cleaning of articles in basket 70. More specifically, agitation element 92 is moved back and forth in an oscillatory motion.

After the agitation phase of the wash cycle is completed, tub 64 is drained. Laundry articles can then be rinsed by again adding fluid to tub 64, depending on the particulars of the cleaning cycle selected by a user, agitation element 92 may again provide agitation within basket 70. One or more spin cycles may also be used. In particular, a spin cycle may be applied after the wash cycle and/or after the rinse cycle in order to wring wash fluid from the articles being washed. During a spin cycle, basket 70 is rotated at relatively high speeds.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Referring now to FIG. 3 along with FIG. 2, the present disclosure is further directed to methods for operating a washing machine appliance 50 which advantageously allow a user of the washing machine appliance 50 to choose a desired treatment option for articles to be washed, and to further independently choose a desired temperature for the articles to be washed. The present disclosure is additionally directed to washing machine appliances 50 which provide such operation. Washing machine appliances 50 according to the present disclosure may thus operate based on the independent treatment and temperature desires of the user, without conflicts between such selected options. Controller 100 can generally be programmed to implement such methods, and thus may be configured to perform the various steps thereof.

As illustrated in FIG. 2 and as discussed above, a washing machine appliance 50 according to the present disclosure may include input selectors 60. Such input selectors 60 may include a temperature option selector 110 and a separate treatment option selector 112. Such selectors 110, 112 in exemplary embodiments as illustrated may be knobs. Alternatively, however, such selectors may be buttons, portions of a touchscreen, or other suitable user selectable components. The selectors 110, 112 may each be in operative communication with controller 100, such that controller 100 operates and controls operation of other components of the washing machine appliance 50 based on user manipulation of the selectors 110, 112. Further, the selectors 110, 112 may advantageously allow treatment option selection independent from temperature option selection, as discussed below.

The temperature option selector 110 may be configured for temperature option selection. For example, a user may manipulate the selector 110 to choose between a number of temperature options 114. For example, temperature options 114 may include a hot temperature, which may be for example between approximately 110 and approximately 130 degrees Fahrenheit, such as between approximately 115 and approximately 125 degrees Fahrenheit. Temperature options 114 may further include a warm temperature, which may be for example between approximately 80 and approximately 110 degrees Fahrenheit, such as between approximately 85 and approximately 105 degrees Fahrenheit. Temperature options 114 may further include a cold temperature, which may be for example between approximately 50 and approximately 80 degrees Fahrenheit, such as between approximately 55 and approximately 70 degrees Fahrenheit. Cold water may be obtained through operation of the cold liquid conduit 76 to flow water therethrough while not operating the hot liquid conduit 78, such as via valve 74. Hot water may be obtained through operation of the hot liquid conduit 78 to flow water therethrough while not operating the cold liquid conduit 76, such as via valve 74. Warm water may be obtained through operation of the cold liquid conduit 76 and the hot liquid conduit 78 to flow water therethrough, such as via valve 74.

The treatment option selector 112 may be configured for treatment option selection. For example, a user may manipulate the selector 112 to choose between a number of treatment options 116 which may correspond to a stain on one or more articles to be washed in the appliance 50. In exemplary embodiments, such treatment options 116 are stain treatment options. For example, treatment options 116 may include a beverage stain option, a blood stain option, a dirt stain option, a dye stain option, a food stain option, an oil stain option, etc. Each treatment option 116 may be associated with a temperature or temperature range that is suitable for treatment of the stain. Such associated temperatures or temperature ranges may be predetermined as generally optimal for the selected treatment. In some embodiments, the temperature or temperature range associated with a specific treatment option 116 may be a hot temperature, a warm temperature or a cold temperature as discussed above. In other embodiments, the temperature or temperature range associated with a specific treatment option 116 may be a custom temperature or temperature range, which may be within, higher or lower than the temperature(s) discussed above, and which may provide generally optimal treatment.

Each treatment option 116 may further be associated with various time periods for washing articles that are suitable for treatment of the associated stain. For example, a particular stain may optimally require increased or decreased time periods of rotating, and thus agitation, during washing machine appliance 50 operation. Thus, a first period and a second period may for example be associated with each treatment option 116. The first and second periods may be time periods for agitation of the articles within the tub 64, such as via rotation of agitation element 92 or the basket 70, to provide optimal treatment of a particular stain. Each treatment option 116 thus correlates to a particular first period and second period, which may each be independent of and different from the first period and second period of other treatment options 116.

Each treatment option 116 may further be associated with various rates of agitation of the articles within the tub 64 that are suitable for treatment of the associated stain. For example, a particular stain may optimally require increased or decreased rates of rotating, and thus agitation, during washing machine appliance 50 operation. Thus, a first rate and a second rate may for example be associated with each treatment option 116. The first and second rates may be rotation rates (for example, motor speeds) for agitation of the articles within the tub 64 to provide optimal treatment of a particular stain. Each treatment option 116 thus correlates to a particular first rate and second rate, which may each be independent of and different from the first rate and second rate of other treatment options 116.

As illustrated in FIG. 3, a method according to the present disclosure may include, for example, the step 200 of flowing a first volume of liquid, such as water which may include wash additives therein and thus be a wash fluid, into tub 64. The first volume of liquid may be at a temperature that is correlated to a treatment option 116 selected by a user, as discussed above. Further, such temperature may be independent of the temperature option 114 selected by the user. The first volume of liquid may generally be a volume that is less than an total volume utilized during a main wash of the articles, such as between approximately 25% and approximately 75% of the total volume. The first volume may be utilized for an initial wash of articles within the basket 70, to provide an initial treatment of stains on such articles per the treatment option 116 selected by the user.

The volume of liquid flowed into the tub 64, such as the first volume and a second volume and total volume as discussed below, may be monitored and determined using a variety of methods and/or apparatus. For example, in some embodiments, sensors 120 may be included in the appliance 50, such as on the tub 64. A sensor may, for example, be a weight sensor configured to measure a weight of tub 64 and the contents therein, or may be a pressure sensor, or may be a height sensor or any other suitable sensor. The sensors 120 may measure characteristics of the liquid as it flows into the tub 64. Sensors 120 may further be in operative communication with controller 100, such that controller 100 can control valve 74, etc. based on sensor 120 signals. The characteristics measured by sensors 120 may correspond to the volume within the tub 64, such that the various volumes discussed herein can be monitored by the sensor 120. In alternative embodiments, the various volume as discussed herein may be monitored and determined based on the time during which liquid is allowed to flow into the tub 64.

A method according to the present disclosure may further, for example, include the step 205 of directing a wash additive into the tub 64. Wash additive may be for example be directed from dispenser 84 into the tub 64, such as through nozzle 72. In some embodiments, such directing step 205 may be a passive step, such that when liquid (such as the first volume of liquid) is flowed into the tub 64 the wash additive is directed therewith. In other embodiments, controller 100 may be in operative communication with the dispenser 84, and can operate the dispenser 84 to directly or indirectly direct wash additive into the tub 64. In exemplary embodiments, the wash additive is directed into the tub 64 during flowing of the first volume of liquid into the tub 200.

A method according to the present disclosure may further, for example, include the step 210 of agitating the articles within the tub 64 for a first period at a first rate. Such step 210 in exemplary embodiments occurs after step 200. The first period and the first rate may, for example, correlate to the treatment option 116 selected by the user, as discussed above. Agitating the articles for the first period at the first rate may be initially agitation to initially and at least partially treat stains on the articles, including those corresponding to the selected treatment option 116. Further, advantageously, because wash additive may be added before such step 210 and the liquid may be at a first volume, the wash fluid within the tub 64 may be at a relatively concentrated level and may thus provide increased treatment benefits.

A method according to the present disclosure may include, for example, the step 220 of flowing a second volume of liquid, such as water, into tub 64. Such step 220 in exemplary embodiments occurs after step 210. The second volume of liquid may be at a temperature that is correlated to a temperature option 114 selected by a user, as discussed above. In particular, in exemplary embodiments, the second volume of liquid may be at a temperature such that a resultant temperature of a total volume of liquid within the tub 64 (the total of the first volume and second volume) is within a temperature range of the temperature option 114 selected by the user. For example, if the temperature option 114 is a hot temperature and the temperature of the first volume is at a cold temperature, the temperature of the second volume may be at a temperature hotter than the hot temperature such that the resultant temperature of the total volume of liquid is within the hot temperature range. If the temperature option 114 is a cold temperature and the temperature of the first volume is at a hot temperature, the temperature of the second volume may be at a temperature colder than the cold temperature such that the resultant temperature of the total volume of liquid is within the cold temperature range. Further, such temperature of the second volume of liquid, as well as the resultant temperature, may be independent of the treatment option 116 selected by the user.

A method according to the present disclosure may further, for example, include the step 230 of agitating the articles within the tub 64 for a second period at a second rate. Such step 230 in exemplary embodiments occurs after step 220. The second period and the second rate may, for example, correlate to the treatment option 116 selected by the user, as discussed above. The second period and second rate may additionally further correlate to the temperature option 114 selected by the user, and may thus be modified based on such independent temperature option 114 selection. Agitating the articles for the second period at the second rate may be agitation as in a normal main wash cycle, and may further treat stains on the articles, including those corresponding to the selected treatment option 116. Notable, no further wash additive may be required for such agitation 230, as the wash additive may have been added with the first volume of liquid. Further, in exemplary embodiments, the second period may be longer than the first period, to facilitate complete washing of the articles within tub 64.

Notably, in exemplary embodiments, the steps 200, 210, 220, 230 may occur after the temperature option 114 and treatment option 116 are selected by a user. Further, it should be understood that the temperature option 114 and treatment option 116 may be selected independently of each other. Accordingly user may advantageously have stains treated in accordance with selected treatment options 116, and further have the articles which contain the stains generally washed in accordance with selected temperature options 114, without concern for conflicts between the temperatures, etc. correlated with such options 114, 116.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the washing machine appliance having a tub and a basket rotatably mounted within the tub, the basket defining a liquid chamber for receipt of articles for washing, the method comprising:

flowing a first volume of liquid into the tub during a main wash cycle based on a treatment option selected by a user, the first volume of liquid at a temperature controlled by the treatment option and independent of a temperature option selected by the user;

agitating the articles within the basket for a first period at a first rate;

flowing a second volume of liquid into the tub during the main wash cycle based on the treatment option selected by the user, the second volume of liquid at a temperature controlled by the temperature option and independent of the treatment option; and agitating the articles within the basket for a second period at a second rate, wherein the treatment option and the temperature option are selected by a user independently of each other.

2. The method of claim 1, wherein the second volume of liquid is at a temperature such that a resultant temperature of a total volume of liquid within the tub is within a temperature range of the temperature option selected by a user.

3. The method of claim 1, wherein the first period and the first rate are correlated to the treatment option selected by a user.

4. The method of claim 1, wherein the second period and the second rate are correlated to the treatment option selected by a user.

5. The method of claim 1, wherein the second period is longer than the first period.

6. The method of claim 1, further comprising directing a wash additive into the tub.

7. The method of claim 6, wherein the wash additive is a detergent.

8. The method of claim 6, wherein the wash additive is directed into the tub during flowing the first volume of liquid into the tub.

9. The method of claim 1, wherein flowing the first volume, agitating the articles within the tub for the first period at the first rate, flowing the second volume, and agitating the articles within the tub for the second period at the second rate occur after the treatment option and the temperature option are selected by the user.

10. The method of claim 1, wherein agitating the articles within the tub for the first period at the first rate occurs after flowing the first volume, flowing the second volume occurs after agitating the articles within the tub for the first period at the first rate, and agitating the articles within the tub for the second period at the second rate occurs after flowing the second volume.

* * * * *